US009082275B2

(12) United States Patent
Baker

(10) Patent No.: US 9,082,275 B2
(45) Date of Patent: Jul. 14, 2015

(54) ALARM DEVICE FOR ALERTING HAZARDOUS CONDITIONS

(76) Inventor: Lyndon Frederick Baker, Queensland (AU)

( * ) Notice: Subject to any disclaimer, the term of this patent is extended or adjusted under 35 U.S.C. 154(b) by 40 days.

(21) Appl. No.: 13/984,706

(22) PCT Filed: Feb. 17, 2012

(86) PCT No.: PCT/AU2012/000152

§ 371 (c)(1),
(2), (4) Date: Aug. 9, 2013

(87) PCT Pub. No.: WO2012/109710

PCT Pub. Date: Aug. 23, 2012

(65) Prior Publication Data

US 2013/0314225 A1 Nov. 28, 2013

(30) Foreign Application Priority Data

Feb. 18, 2011 (AU) ..... 2011900546
Dec. 18, 2011 (AU) ..... 2011905275

(51) Int. Cl.

| | |
|---|---|
| ***G08B 17/10*** | (2006.01) |
| ***G08B 19/00*** | (2006.01) |
| ***G08B 23/00*** | (2006.01) |
| ***G08B 17/11*** | (2006.01) |
| ***G08B 29/18*** | (2006.01) |
| *G08B 17/117* | (2006.01) |

(52) U.S. Cl.

CPC ..... *G08B 17/10* (2013.01); *G08B 17/11* (2013.01); *G08B 19/00* (2013.01); *G08B 23/00* (2013.01); *G08B 29/183* (2013.01); *G08B 17/117* (2013.01)

(58) Field of Classification Search

CPC ..... G08B 23/00; G08B 25/10; G08B 19/00; G08B 19/005; G08B 29/183
USPC ..... 340/517, 506, 521, 522, 578, 628
See application file for complete search history.

(56) References Cited

U.S. PATENT DOCUMENTS

| | | | | |
|---|---|---|---|---|
| 5,486,810 | A | 1/1996 | Schwarz | |
| 5,592,147 | A | 1/1997 | Wong | |
| 6,624,750 | B1 * | 9/2003 | Marman et al. | 340/521 |

(Continued)

FOREIGN PATENT DOCUMENTS

| | | |
|---|---|---|
| GB | 2 457 696 | 8/2009 |

OTHER PUBLICATIONS

International Search Report, PCT/AU2012/000152, Mar. 22, 2012.

*Primary Examiner* — John A Tweel, Jr.
(74) *Attorney, Agent, or Firm* — Young & Thompson

(57) ABSTRACT

A smoke alarm device includes a motion detection module generating a motion detection signal on detecting human motion within a detection zone, a primary sensing module arranged to generate an alarm signal where the primary sensing module senses a hazardous condition, at least one secondary sensing module arranged to generate an alarm signal where the secondary sensing module senses a hazardous condition, and a controller arranged to activate an audible alarm module on receiving any of the alarm signals. The controller has a timer and is arranged to be in a hush state for a preset time period upon receiving the motion detection signal. In the hush state, the controller is arranged to activate the audible alarm module upon receiving alarm signals from both the primary and the at least one secondary sensing modules, or from either the primary or any one of the at least one secondary sensing module.

18 Claims, 7 Drawing Sheets

(56) References Cited

U.S. PATENT DOCUMENTS

| | | | | |
|---|---|---|---|---|
| 6,653,939 | B2 * | 11/2003 | Galloway | 340/555 |
| 7,307,539 | B2 * | 12/2007 | Harvey et al. | 340/628 |
| 7,642,924 | B2 | 1/2010 | Andres et al. | |
| 7,994,928 | B2 * | 8/2011 | Richmond | 340/628 |
| 8,890,034 | B2 * | 11/2014 | Mishra | 340/506 |
| 2004/0189460 | A1 * | 9/2004 | Heaton et al. | 340/500 |

* cited by examiner

ALARM DEVICE FOR ALERTING HAZARDOUS CONDITIONS

FIELD OF THE INVENTION

THIS INVENTION relates to an alarm device for alerting hazardous conditions in a building, and, in particular but not limited thereto, a smoke alarm device having a primary smoke sensor module and at least one secondary sensor for sensing gas and/or particles in smoke.

BACKGROUND OF THE INVENTION

Ionization type smoke alarms and photoelectric type smoke alarms are commonly used in residential buildings. Each type has its advantages. Ionization type smoke alarms generally respond faster to flaming fires, while photoelectric (optical) type smoke alarms generally respond faster to smouldering fires. Although both ionization and photoelectrical smoke alarms meet the standards established by the fire protection industry, for improved protection authorities such as the National Fire Protection Association (NFPA) recommend that both types be used in the home. (NFPA "What you should know about Smoke Alarms" http://www.nfpa.org/assets/files//PDF/Public%20Education/NFPASmokeAlarm-FactSheet.pdf) However ionization type smoke alarms tend to generate nuisance alarms when installed near kitchens. They are often activated to generate loud audible alarms or sounds during routine cooking procedures. Such nuisance alarms or sounds are very discomforting to the occupants. Nuisance alarms are the main reason occupants disable smoke alarms. A 2007 Seattle study found 20% of ionization alarms were non-functional one year after installation. (Mueller B. A. Sidman E. A. "Randomized Controlled Trial of Ionization and Photoelectric Smoke Alarm Functionality" *Injury Prevention* 2008; 14:80-86) Because disabled smoke alarms pose a major safety risk, there is a need in today's market for an ionization smoke alarm that is less likely to generate nuisance alarms. In contrast photoelectric smoke alarms are less likely to nuisance alarm. The same study found that only 5% of photoelectric smoke alarms were non-functional after the same period.

Currently occupants are advised to relocate an ionization smoke alarm away from the kitchen surrounds in order to minimise this problem. However relocation might not be possible in a small dwelling as the most important location for a smoke alarm, just outside the bedroom, might be close to the kitchen. When relocation is not possible, the occupant is advised to install a photoelectric type smoke alarm instead. Using photoelectric type smoke alarms reduces nuisance alarms but also reduces protection. For improved protection both types of smoke alarm should be used. Alternatively, the occupant is advised to install an ionization smoke alarm that features a "Hush" button. Hush buttons can deactivate/desensitize the smoke alarm for a short period. Unfortunately this, too, does not solve the problem since such buttons are beyond reach for most occupants due to positioning of the alarms on walls and ceilings. The smoke alarms used in the Seattle study all featured hush buttons. Even those who can reach the hush button are still at risk of becoming desensitized to the smoke alarm if it sounds frequently.

The applicant is aware of several proposals for overcoming above mentioned prior art problems. For example, the disclosures in patent references RU2207630 (Savushkin, V. A.), JP2006-202080 (Takashima, Hiromasa), JP2007-148694 (Sekine, Takehiro), BE1016841 (Tanghe, Freddy), GB2457696 (Bone D. G.), JP2010-198406 (Shinozaki, Ritsu) teach either a passive infrared motion Detector (PID) or a Doppler Effect motion Detector that automatically desensitizes a fire alarm during human presence in the area. Since most nuisance alarms occur during meal preparation and hence during human presence, these proposals alleviate the problem to some extent. However these proposals cannot be allowed to completely deactivate or significantly desensitize the alarm for an extended period of time. Doing so would create an unacceptable risk for the occupant and would not meet fire safety standards. This is because such motion Detectors are at risk of responding to pets or children or fire or other interference sources. Unfortunately the lower sensitivity limit for ionization smoke alarms, allowed by most authorities, is not low enough to block many nuisance alarms that commonly occur near the kitchen. (e.g. see Australian Standard 3786-1993, minimum sensitivity for ionization sensors=0.5 MIC×value) Thus, these proposals do not adequately solve the problem. Furthermore, because of the technology employed, all these proposals require at least two separate packages for implementation and are not suitable for drawing their power from the smoke alarm's own battery. This reduces their aesthetics and makes them expensive and hard to install. Also, the PID detectors described in the above patents are likely to see and perhaps respond to a fire or nearby interference sources due to their wide field of view. This could cause alarm desensitization for the wrong reason.

US 2010-0238036 (Holcombe, Wayne T.) discloses a fixed distance proximity detector inclusive in a standard smoke alarm. Unlike PID detectors, such a detector is relatively immune to interference sources since its detection zone is only a short distance below the smoke alarm. It could possibly be used to completely deactivate the alarm whilst still maintaining safety standards. However, for this very reason, it would not normally block nuisance alarms before they occur. Blocking would require a deliberate action by the occupant, such as a hand wave above the head and under the smoke alarm, before cooking commenced. Also, for some occupants, the proximity detection zone would be beyond reach.

U.S. Pat. No. 7,642,924 (Andres, John,) discloses a combination ionization sensor and carbon monoxide (CO) sensor functioning as a smoke alarm. The sensitivity of the ionization sensor changes according to the presence of CO. Since cooking tends to produce less CO than a real fire this technique can reduce nuisance alarms. However to screen against certain cooking activities, such as toasting bread or frying bacon, the CO threshold needs to be set quite high. Although this threshold is acceptable to fire safety authorities, it will nevertheless result in a significant loss in smoke alarm sensitivity which unnecessarily continues around the clock. Alternatively, if the smoke alarm sensitivity is maintained, it will suffer from a significant nuisance alarm problem near the kitchen.

Other multi-sensor fire alarms now arriving on the domestic market introduce heat, carbon monoxide (CO), rate of change measurements and other information, together with smoke sensor measurements, into an onboard algorithm for processing. These devices offer improvements but must still compromise on performance to mitigate nuisance alarms near the kitchen.

An additional problem manifests itself during low battery conditions of ionization and photoelectric smoke alarms as well as other types of alarms. When the battery in these alarms reaches a low power condition a smoke alarm will beep intermittently at about once a minute. This is to alert the occupant of the need to replace the battery. This often occurs in the early hours of the morning when low temperatures maximise the condition. This beep is loud enough to prevent or disturb sleep. As a result, the occupant often cannot postpone the battery change. Additionally the beep is very short in order to preserve the life of the already depleted battery. Because most dwellings are fitted with multiple smoke alarms the faulty smoke alarm can be very hard to find. Thus there is a need for an improved method of locating a smoke, or other, alarm in this condition.

US2010-0238036 (Holcombe, Wayne T.) discloses a method of providing the occupant with a feedback tone when the proximity detector is activated and the smoke alarm is in the low battery state. This system can help some occupants locate an alarm in such a state. However, as mentioned earlier, the proximity detector will be out of reach for other occupants. Thus this method will not always solve the low battery alert problem.

OBJECTS OF THE INVENTION

An object of the invention is to provide an alarm device which alleviates or reduces to a certain level one or more of the above mentioned prior art problems.

Another object of the invention is to provide a compact alarm device with a housing enclosing all modules of the device.

SUMMARY OF THE INVENTION

In one aspect therefore, the present invention resides in an alarm device for alerting hazardous conditions in a building. The device comprises a motion detection module arranged to generate a motion detection signal where motion is detected within a detection zone, a primary sensing module arranged to generate an alarm signal where the primary sensing module senses a hazardous condition at or over a preset level, at least one secondary sensing module arranged to generate an alarm signal where the secondary sensing module senses a hazardous condition at or over a preset level, and a controller arranged to activate an audible alarm module on receiving any of said alarm signals. The controller has a timer and is arranged to be in a hush state for a preset time period upon receiving said motion detection signal. In said hush state, the controller is arranged to activate the audible alarm module upon receiving alarm signals from both the primary and the at least one secondary sensing modules, or from either the primary or any one of said at least one secondary sensing module.

In preference, said device is a smoke alarm. The primary smoke sensing module of the smoke alarm is an ionization smoke sensor and the at least one secondary sensing module of the smoke alarm is for sensing gas and/or particles in smoke. The at least one secondary sensing module may include a photoelectric smoke sensor and/or a carbon monoxide sensor.

The device may have a connector for connection to an external power supply or an internal power supply for supplying power to components of the device. The device may have a housing for fixing to a wall or ceiling of the building, and the motion detection module, the primary sensing module, the at least one secondary sensing module and the controller are positioned within the housing. Desirably, the power supply is positioned within the housing.

The device may have a lens for limiting motion sensing to be within said detection zone. The lens may be in the form of a pin hole lens or a multi-facet lens. The pin hole lens is preferably configured to set the detection zone to be within 30 degrees emanating from the motion detection module. The multi-facet lens is preferably configured to set the detection zone to be between 30 to 120 degrees emanating from the motion detection module. More preferably, the motion detection module is set to limit the detection zone to be above a height that household pets would not cause it to generate a motion detection signal.

In preference, in the hush state the controller is arranged to reduce the overall sensitivity of the device and thereby reduce nuisance alarms. The preset time interval of the hush state can be within 1 second to 1 hour and nominally 10 minutes. After the hush state, the controller is arranged to return to the normal State. In the normal state the controller is arranged to increase the overall sensitivity of the device and thereby provides a better level of protection than in the hush state.

When the secondary sensor is a photoelectric sensor the controller makes use of the superior performance (or relatively faster response) of an ionization/photoelectric combination for detecting fires in the normal state. In the hush state it makes use of the ability of photoelectric sensors to screen against nuisance alarms.

When the secondary sensor is a CO sensor the controller monitors the response of each sensor to determine whether there exists a flaming or smouldering fire scenario. The controller then makes use of the superior performance of an ionization/CO combination for detecting fire in the normal state. In the hush state the controller makes use of the ability of CO sensors to screen against nuisance alarms.

As an additional preferred function, when the at least one secondary sensor is a carbon monoxide sensor, the controller also provides an alert if this gas is detected at an elevated level for an extended period of time, even though a real fire may not have occurred. These levels are published in U.S. Underwriters Laboratories standards UL2034. (E.g. alarm must sound if CO is detected at 400 ppm for 15 minutes.) This can alert the occupant to a dangerous situation as might come from a malfunctioning household heater.

In one form the motion detection module includes a passive infrared motion detector (PID). This detector can be of the single or multiple element pyroelectric type. It can have an infra-red window to screen against visible light and other sources of interference. The PID can also be accompanied by a light emitting diode (LED) to indicate when it has tripped. This feature provides immediate feedback to the occupant if an air draft or some other source of interference is maintaining the device in the hush state.

In one form, the controller is an integrated circuit (IC) micro-controller unit (MCU) and associated peripherals. The controller evaluates changes in the PID output to determine whether to enter the hush state. The MCU integrated circuit includes an array of devices. Additionally the MCU is programmed to cycle in very low power consumption modes by making use of standby timer (clocks). This allows it to draw its power from the smoke alarm's own battery without reducing the battery's service life below the 12 month span required by most authorities.

The associated space savings allow all components to be included in a standard smoke alarm housing.

BRIEF DESCRIPTION OF THE DRAWINGS

In order that the present invention may be more readily understood and be put into practical effect reference will now be made to the accompanying drawings which illustrate non-limiting preferred embodiments of the invention and wherein:—

DETAILED DESCRIPTION OF EMBODIMENTS SHOWN IN THE DRAWINGS

Figure 1:
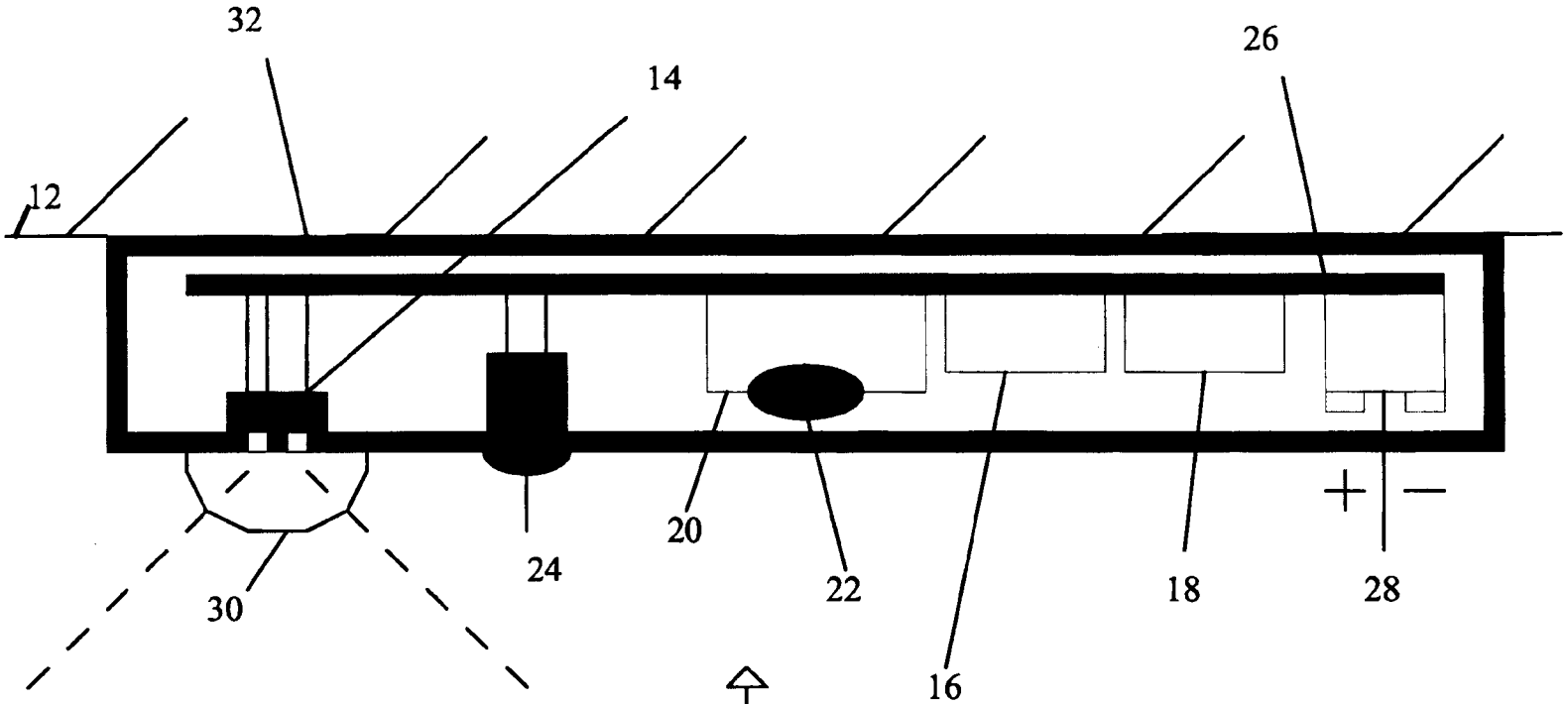
FIG. 1 is a schematic drawing illustrating a cut away view of an embodiment of the alarm device according to the present invention where the PID has a wide field of view.

Referring to the drawings and initially to FIG. 1 there is illustrated in plan cut-away view an embodiment of the alarm device 10 according to the present invention. As shown, the device 10 is fixed to a ceiling 12 of a building. The device can be fixed to the ceiling by any fixing means.

The device 10 of this embodiment is for alerting occupants in the building in the event of fire. The device has a motion detection module 14 in the form of a passive infrared motion detector (PID), a primary sensing module 16 in the form of an ionization sensor, a secondary sensing module 18 which can be a photoelectric sensor or a carbon monoxide (CO) sensor, a controller 20 arranged to activate an audible alarm module 22 in the form of a horn on receiving an alarm signal from the sensors. The controller has a timer (not shown) and is arranged to be in a hush state for a preset time period (10 minutes for this embodiment) upon receiving a motion signal from the PID. In both the Normal State and the said hush state, the controller is arranged to activate the horn upon receiving alarm signals in situations to be described with reference to FIGS. 3 to 6. The hush state is indicated by a lit LED 24. The above mentioned components are connected to conducting paths on a printed circuit board 26 and power is supplied by a battery 28. The PID 14 in this embodiment has a multi-facet lens 30 which provides a detection zone of about 100 degrees emanating from the PID. The Lens can be formed of multiple Fresnel lenses. All the above components are positioned within a housing 32 which is fixed to the ceiling by any known fixing means.

Figure 2:
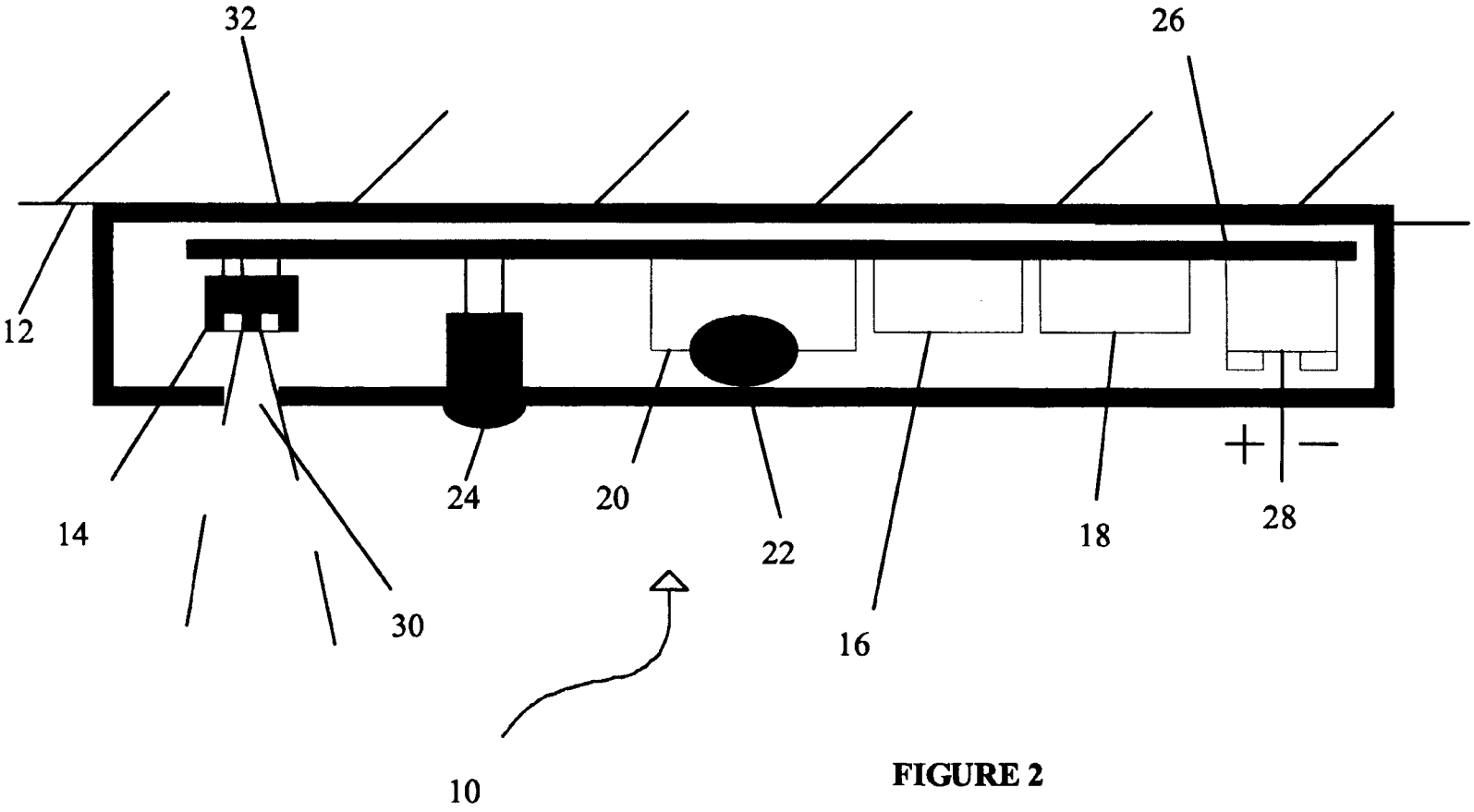
FIG. 2 is a schematic drawing illustrating a cut away view of another embodiment of the alarm device according to the present invention where the PID has a narrow field of view.

The embodiment of the device 10 shown FIG. 2 is substantially the same as that shown in FIG. 1 except that the lens 30 is a pin hole lens for limiting the detection zone to about 20 degrees emanating from the PID 14.

Figure 3:
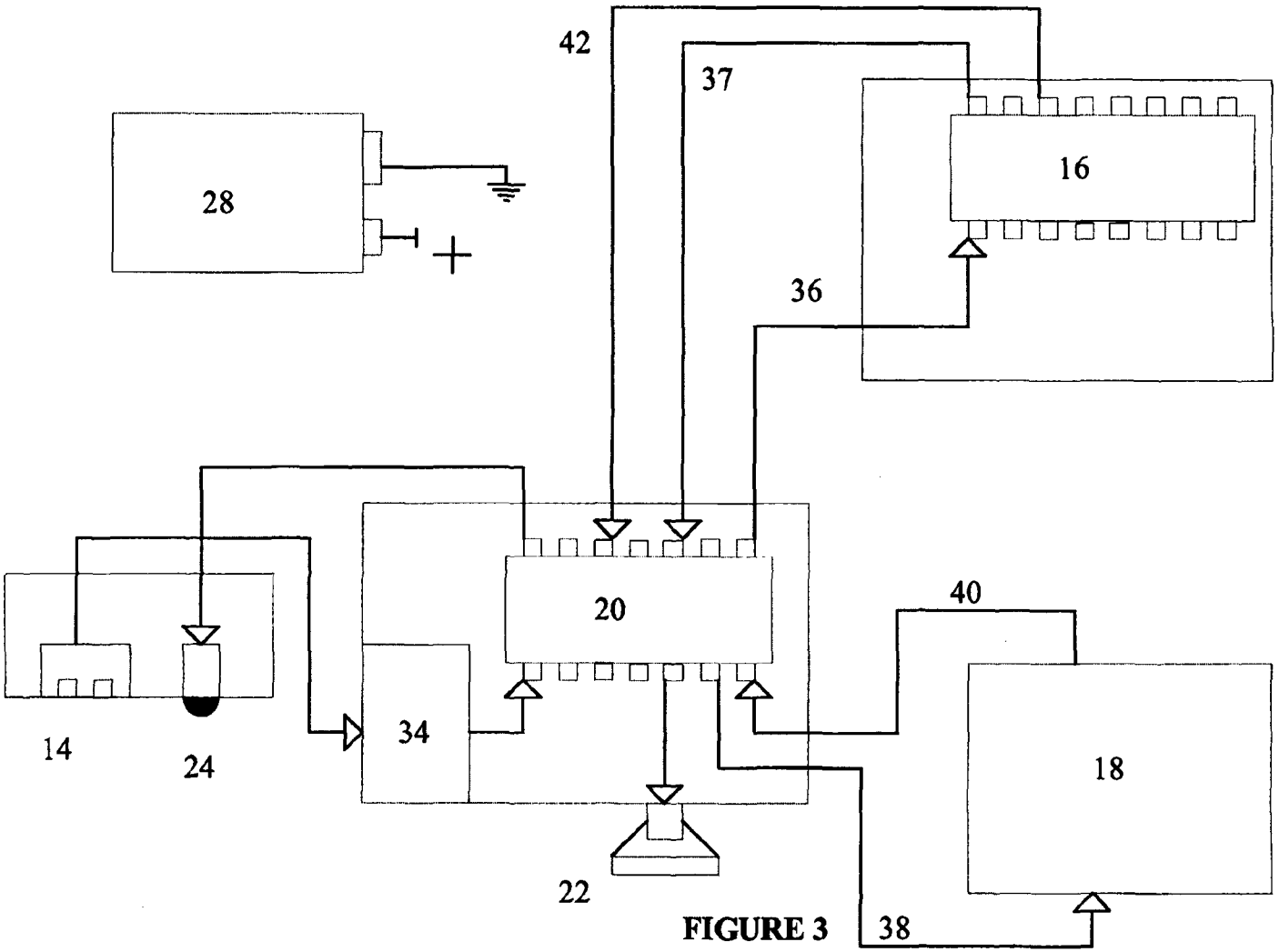
FIG. 3 is a block diagram showing interconnection of various components of the embodiment shown in FIG. 1'.

In the embodiments as shown in FIGS. 1 and 2, the controller 20 is an integrated circuit microcontroller unit (MCU IC) such as Texas Instruments TI MSP430F2013 shown in FIG. 3. The MCU is connected to receive motion detection signals from PID 14 and a conditioning filter 34 is employed to avoid triggering by noise. The filter consists of a simple RC network.

FIG. 3 also shows the connections to and from MCU 20. The MCU connects to the sensitivity pin of the ionization sensor 16 control IC (e.g. Motorola MC145017). This connects to a resistive potential divider inside the IC that sets the default voltage. The MCU through line 36 adjusts the sensitivity of the ionization sensor by adjusting this voltage. A similar connection line 38 is made to adjust sensitivity of the secondary Sensor 18 when it is a photoelectric sensor. The MCU also connects by line 37 to one of the alarm outputs of the ionization sensor control IC which, in conventional smoke alarms, drives a piezoelectric crystal. The MCU monitors activity on this pin to determine whether the ionization sensor has reached its threshold. Again a similar connection through line 40 is made to the secondary Sensor when it is a photoelectric sensor. When the secondary Sensor is a CO sensor this connection still exists however, in the case of an electrochemical type, the output is a current that varies almost linearly with the concentration of CO. The MCU analyses this signal to determine the CO concentration in ppm. A further connection through line 42 is made from the MCU to the low voltage comparator output of the ionization sensor control IC. This alerts the controller if the smoke alarm's battery is running low.

Figure 4:
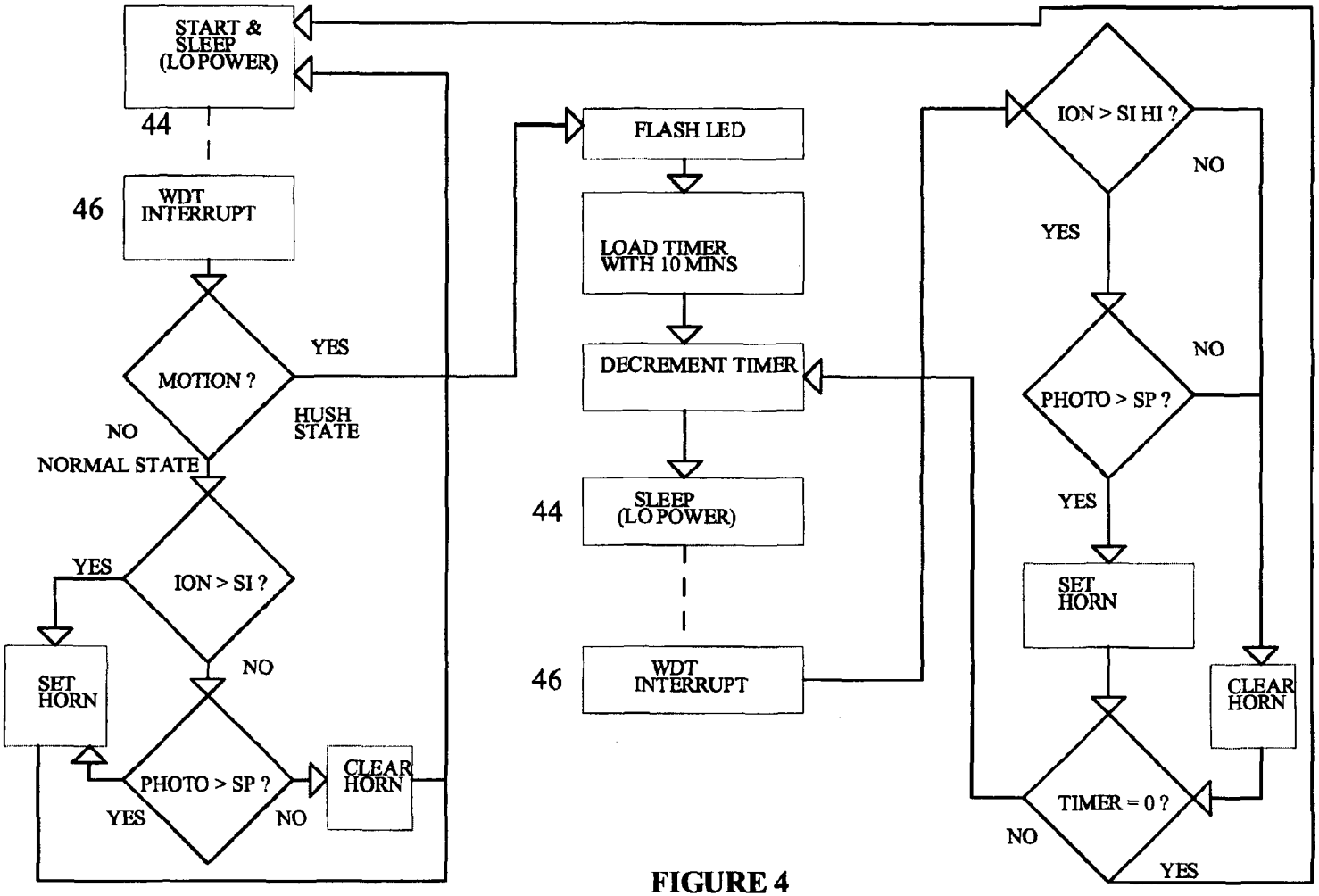
FIG. 4 is a flow chart showing the operational steps of the controller where the secondary sensing module is a photoelectric sensor.
Figure 5:
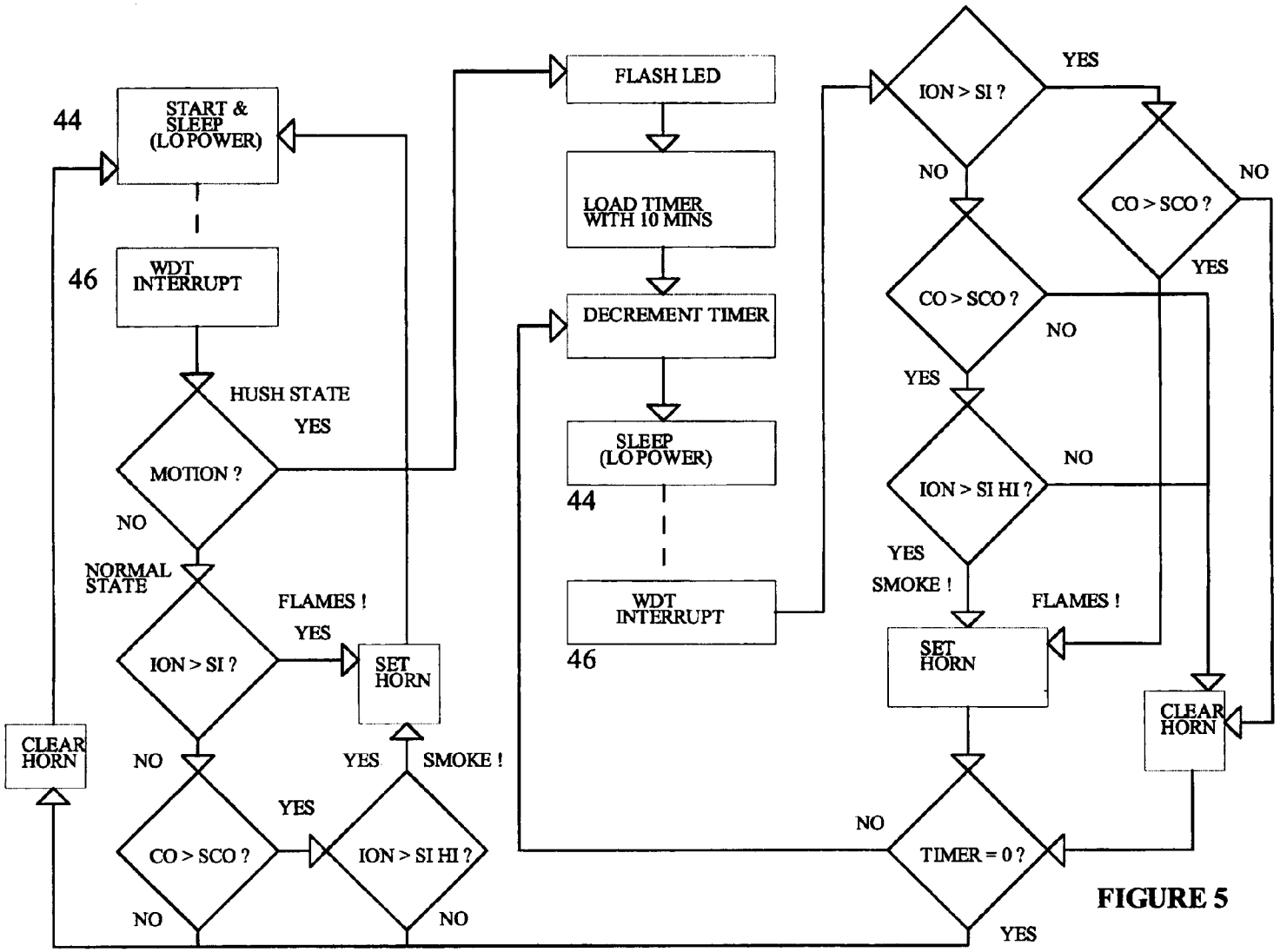
FIG. 5 is a flow chart showing the operational steps of the controller where the secondary sensing module is a carbon monoxide sensor.
Figure 6:
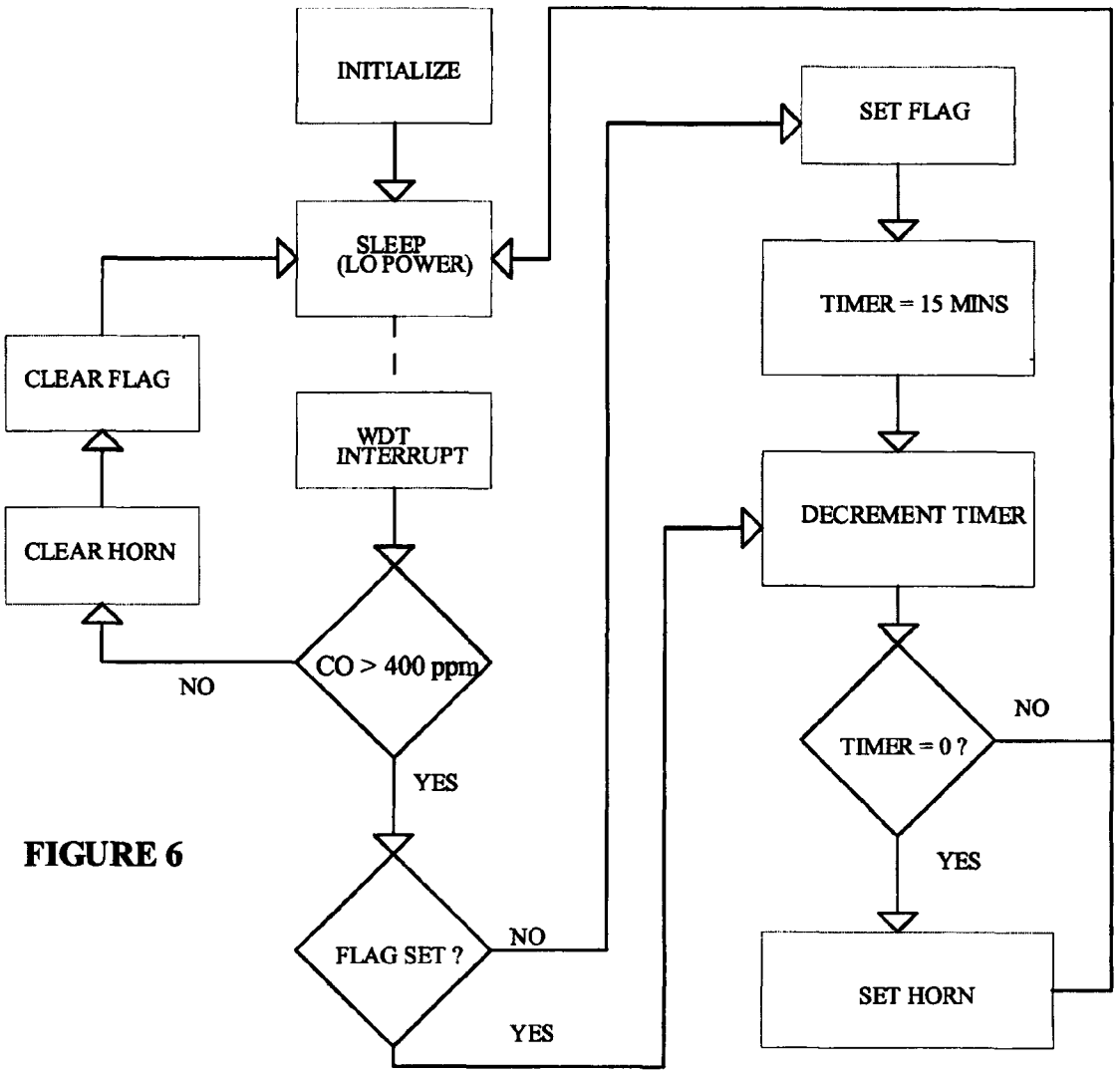
FIG. 6 is a flow chart showing the operational steps of the controller where the secondary sensing module is a carbon monoxide sensor at an elevated level.

Referring to FIGS. 4 to 6 it can be seen from the MCU programming steps that this device 10 is energy frugal and as such it is well suited to a battery powered embodiment. This is achieved by resting the MCU in a low power sleep mode (see box 44) most of the time. Three times a second a watchdog timer 46 wakes the MCU 20 which quickly samples the PID output and compares it to the previous reading before returning to sleep. If the difference in successive PID readings is more than a preset threshold the MCU enters the hush state for 10 minutes and adjusts the sensitivity of the smoke sensors as required. During this state the MCU once again spends most of its time in a low power sleep mode, being woken by the watch dog timer three times a second so as to decrement the timer.

Additionally, FIG. 4 shows, in flowchart form, how the controller sounds an alarm if either the ionization sensor or the photoelectric sensor reaches its sensitivity in the normal state. It also shows it will not sound an alarm unless both sensors reach their sensitivity in the hush state. Similarly FIG. 5 shows, in flowchart form, how the controller monitors whether the ionization sensitivity (SI) is reached before the carbon monoxide sensitivity (SCO), or vice versa, so as to determine whether there exists a flaming fire scenario or a smouldering fire scenario. The controller subsequently adjusts the sensitivity of the device so as to optimize its performance for the appropriate scenario.

Although the device 10 of this embodiment described relates to ionization sensors it will be appreciated that it could also be used to deactivate/desensitize other sensors in combination fire alarms that may or may not include ionization sensors. In special circumstances it would also be suitable for deactivating/desensitizing a single sensor fire alarm such as a standalone ionization smoke alarm.

Control Low Battery Alert Problem

Figure 7:
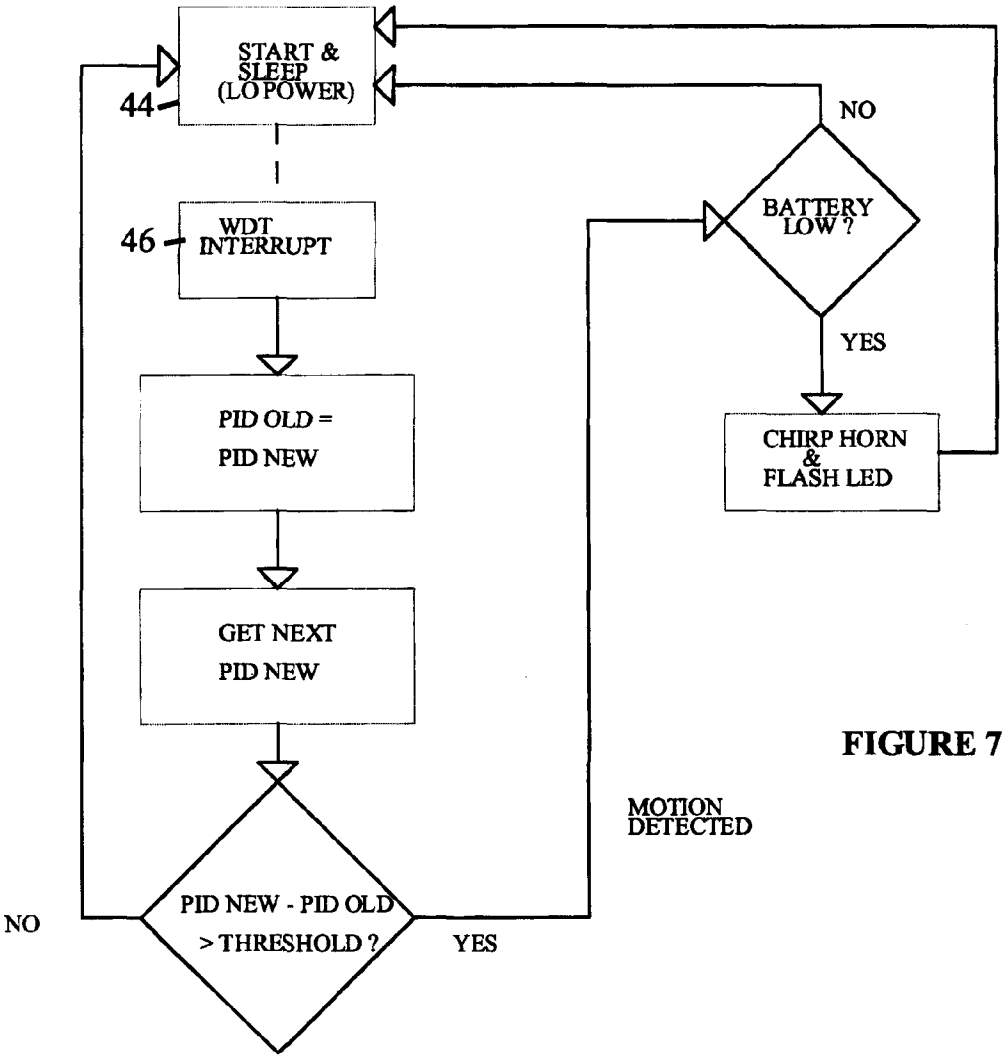
FIG. 7 is flow chart showing operation steps of the controller for providing a low battery alert.

The controller 20 is also programmed to provide a short audible output from the horn 22 and flash the LED 24 when it is in the low battery state and when the PID detects motion. This feature helps the occupant locate an alarm device in such a state when multiple alarms are installed. The occupant needs only walk under the suspected alarms to ascertain which is at fault. FIG. 7 shows the steps taken by the MCU program for the low battery finder function. This feature may also be used to alert the occupant when the alarm has detected another fault or has other information for the occupant.

As in FIG. 4 it can be seen that the MCU spends most of its time in a low power sleep mode. It is woken three times a second by the watch dog timer to check the battery low voltage pin on the ionization smoke alarm control IC as well as the PID output. At this time it will also chirp the horn and flash the LED if required. This figure also shows in more detail how the MCU/PID combination detects motion in this invention. Three times a second the MCU samples the PID output. The newest value is kept and the oldest value discarded. The MCU compares the last two samples. When the difference is above a preset threshold the MCU assumes an object's motion has been detected.

The device 10 is an adaptive smoke alarm and all components are constrained in one package 32 and able to interact with each other. The controller 20 is able to provide an audible warning of smoke or fire if the smoke alarm's sensitivity threshold is exceeded. In response to an object's motion in its vicinity, as is the case when the occupant is cooking and the device is located nearby, the controller initiates a hush state. This state reduces the overall sensitivity of the smoke alarm and thereby reduces nuisance alarms caused by cooking. However, by various interactions, the hush state maintains a level of protection acceptable to fire safety authorities. After the hush state, in particularly when the occupant is asleep, the controller returns to the Normal State. The Normal State increases the overall sensitivity of the smoke alarm and thereby provides a better level of protection then the hush state.

When the secondary Sensor 18 is a photoelectric sensor the controller 20 makes use of the natural resistance of these sensors to cooking nuisance alarms. In the Normal State, the controller sounds an alarm if either the ionization sensor or the photoelectric sensor reaches its sensitivity level (SI & SP respectively). However, during the Hush sate, the controller increases the sensitivity of the ionization sensor to SIhigh but will only sound an alarm if both sensors have reached their threshold. This procedure screens against cooking nuisance alarms whilst still providing an acceptable level of protection. The controller may also adjust the sensitivity of the photoelectric sensor to improve the performance of the device.

When the secondary Sensor is a CO sensor the controller makes use of several observations. Firstly, a smouldering fire will have CO present in detectable amounts (SCO approximately 20 to 30 ppm) before typical ionization smoke alarm sensitivities (SI) are reached. Secondly, in a flaming fire the opposite usually occurs with SI being reached before SCO. Thirdly, a real fire, once it is established, produces more CO than cooking does. For these reasons, if SI is reached before SCO the controller assumes a flaming fire scenario. If it is in the normal state it sounds an alarm immediately thus making use of the faster response of ionization sensors in this scenario. If it is in the hush state the controller waits until both SI and SCO are reached before sounding an alarm. This simulates a photoelectric sensor and thus screens against nuisance alarms. Whilst not providing as fast a response as an ionization sensor in this scenario, it nevertheless provides a level of protection acceptable to fire safety authorities. Conversely, if SCO is reached before SI the controller assumes a smouldering fire scenario. In this case, in both the normal and hush states, the controller increases the sensitivity of the ionization sensor to SIhigh but will only sound an alarm it both SIhigh and SCO are met. Again this simulates a photoelectric sensor and thus screens against nuisance alarms. It also makes use of the faster response of photoelectric sensors in this scenario.

With either secondary sensor this device effectively responds similarly to a combination ionization/photoelectric smoke alarm in the normal state and a stand alone photoelectric smoke alarm in the hush state. It thus provides the best response to both flaming and smouldering fires in the Normal State. In the hush state it screens against cooking nuisance alarms whilst providing a reduced, but acceptable, level of protection.

In both the normal state and the hush state the controller may also sound an alarm if some other combination of sensor outputs and timeouts occurs. The controller may also allow one sensor to adjust the sensitivity of the other sensor as is done in some multisensor smoke alarms. However the device is always configured so as to provide a general, but acceptable, loss of sensitivity during an object's motion in its vicinity in order to screen against nuisance alarms followed by a return to a higher sensitivity at other times.

The PID detector is of the single or multiple element pyroelectric type. It has an infra-red window to help screen against visible light and other sources of interference. Infrared light falling on the element(s) from a moving source changes its output current. The PID may have a wide field of view of a room or its surrounds through a multi-facet lens or similar device which divides its viewing area into zones and thus aids in the detection of motion. Such an embodiment will conveniently initiate the hush state whenever the occupant is in the vicinity. However it is also likely to do this if a real fire occurs, given that all fires produce infrared light. This is because the wide field of view is likely to see a source of interference in its vicinity. Alternatively the PID may have a narrow field of view through a pin-hole lens or similar style enclosure. The narrow field of view is directly below the invention such that it will be unlikely to respond to a fire in its early stages or some other source of interference as it will be unlikely to see it. However, if positioned over a walk-way near the kitchen, the PID will most likely maintain the invention in the hush state during meal preparation. This is because the occupant will most likely walk under the PID prior to cooking. If a nuisance alarm does occur, even an occupant unfamiliar with the invention will naturally move under the smoke alarm e.g. to waft away smoke. This movement will itself normally silence the alarm. Because the sound of a smoke alarm is quite discomforting, the speed with which nuisance alarms can be dealt with in this manner is an advantage over the traditional Hush button. When employing a narrow field of view directly below itself the PID operates with low gain as it needs to detect only the upper part of the occupant, approximately. This further reduces the chances of a pet or some other source of interference initiating the hush state. The PID is also accompanied by a Light Emitting Diode (LED) to indicate when it has tripped. This feature provides immediate feedback to the occupant if an air draft or some other source of interference is maintaining the invention in the hush state. The PID/controller combination may also include additional light filters and software processing to better discern the difference between the radiation signature of an occupant and that of a fire.

Whilst the above has been given by way of illustrative example of the present invention, many variations and modifications will be apparent to those skilled in the art without departing from the broad ambit and scope of the invention as herein set forth in the following claims.

The invention claimed is:

1. An alarm device for alerting hazardous conditions in a building, comprising a motion detection module arranged to generate a motion detection signal where motion is detected within a detection zone, a primary sensing module arranged to generate an alarm signal where the primary sensing module senses a hazardous condition at or over a preset level, at least one secondary sensing module arranged to generate an alarm signal where the secondary sensing module senses a hazardous condition at or over a preset level, and a controller arranged to activate an audible alarm module on receiving any of said alarm signals in a normal state of operation, the controller having a timer and being arranged to transfer from said normal state to a hush state of operation for a preset time period upon receiving said motion signal, and in said hush state the controller being arranged to activate the audible alarm module upon receiving alarm signals from both the primary and the at least one secondary sensing modules, or from either the primary or any one of said at least one secondary sensing modules.

2. The device according to claim 1 wherein said device is configured as a smoke alarm, and the primary sensing module is an ionization smoke sensor and the at least one secondary sensing module is for sensing gas and/or particles in smoke.

3. The device according to claim 2 wherein the at least one secondary sensing module includes a photoelectric smoke sensor and/or a carbon mono sensor.

4. The device according to claim 1 further including a connector for connection to an external power supply or an internal power supply for supplying power to components of the device.

5. The device according to claim 1 further having a housing for fixing to a wall or ceiling of the building, and the motion detection module, the primary sensing module, the at least one secondary sensing module and the controller are positioned within the housing.

6. The device according to claim 1 wherein the motion detection module having a lens for limiting motion sensing to be within said detection zone.

7. The device according to claim 6 wherein the lens is in the form of a pin hole lens or a multi-facet lens.

8. The device according to claim 7 wherein the pin hole lens is configured to set the detection zone to be within 30 degrees emanating from the motion detection module.

9. The device according to claim 7 wherein the multi-facet lens is configured to set the detection zone to be between 30 to 120 degrees emanating from the motion detection module.

10. The device according to claim 1 wherein the motion detection module is set to limit the detection zone to be above a height such that household pets will not cause it to generate a motion detection signal.

11. The device according to claim 1 wherein in the hush state the controller is arranged to reduce the overall sensitivity of the device and thereby reduces nuisance alarms.

12. The device according to claim 1 wherein the preset time interval of the hush state is set to be within 1 second to 1 hour and after the hush state, the controller is arranged to return to its normal state wherein the controller increases the overall sensitivity of the device and thereby provides an elevated level of protection than in the hush state.

13. The device according to claim 12 wherein in the normal state, the controller is arranged to activate an alarm if either the ionization sensor or the photoelectric sensor reaches its sensitivity level and during the hush state, the controller increases the sensitivity level of the ionization sensor and is arranged to activate an alarm only if both sensors have reached their threshold.

14. The device according to claim 1 wherein the at least one secondary sensing module is a CO sensor and the controller is arranged to monitor hazardous conditions for determining operational steps.

15. The alarm device of claim 1 wherein the motion Detector is a passive infrared detector (PID) of the single or multiple element pyroelectric type with an infra-red window.

16. The alarm device of claim 1 whereby the controller will provide an audible alarm and a LED flash, when it detects an objects motion and the smoke alarm battery is below the low battery threshold or has a fault or other information, and thereby alert the occupant to its condition.

17. The smoke alarm of claim where other combinations of sensitivities, timeouts and interactions are used to reduce cooking nuisance alarms during the hush state.

18. The alarm device of claim 14 whereby the controller will sound an audible alarm if carbon monoxide is sensed at an elevated level for an extended period of time, even though a real fire may not exist.

* * * * *